US011578498B2

(12) United States Patent
Greci et al.

(10) Patent No.: US 11,578,498 B2
(45) Date of Patent: Feb. 14, 2023

(54) EXPANDABLE METAL FOR ANCHORING POSTS

(71) Applicant: Halliburton Energy Services, Inc., Houston, TX (US)

(72) Inventors: Stephen Michael Greci, Carrollton, TX (US); Luke William Holderman, Tuas (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/228,137

(22) Filed: Apr. 12, 2021

(65) Prior Publication Data

US 2022/0325552 A1 Oct. 13, 2022

(51) Int. Cl.
*E04H 12/34* (2006.01)
*E04H 12/22* (2006.01)

(52) U.S. Cl.
CPC ..... *E04H 12/347* (2013.01); *E04H 12/2223* (2013.01)

(58) Field of Classification Search
CPC ..... E04H 12/2215; E04H 12/2223; E04H 12/2292; E04H 12/347
See application file for complete search history.

(56) References Cited

U.S. PATENT DOCUMENTS 1,982,569 A * 11/1934 Byrdartherj ..... E04H 12/2292 52/298
3,046,601 A 7/1962 Hubbert et al.
3,385,367 A 5/1968 Kollsman
4,445,694 A 5/1984 Flaherty
4,612,985 A 9/1986 Rubbo et al.
4,846,278 A 7/1989 Robbins
(Continued)

FOREIGN PATENT DOCUMENTS

CA 2751473 A1 8/2010
CA 2751473 C 9/2014
(Continued)

OTHER PUBLICATIONS

International Search Report and Written Opinion dated Aug. 2, 2018, International PCT Application No. PCT/US2017/061307.
(Continued)

*Primary Examiner* — Christine T Cajilig
(74) *Attorney, Agent, or Firm* — McGuireWoods LLP

(57) ABSTRACT

Apparatuses and methods for setting posts of columns in to the ground are provided. Expandable metals in response to hydrolysis that tend to fill in spaces and cavities, even over time, which is a useful feature when setting columns into the ground. A hydrolyzing fluid can be supplied, as necessary, to cause the hydrolysis of the expanding metal, or supplied by ground water. Upon hydrolysis, the expanding metal expands around the column to adhere and grip the column securely, while the metal may also expand outwardly to increase cross-sectional bulk lending to a more overall stabilization of a set column. The expandable metal may be provided as a solid sleeve drivable into the ground with a post, as an auger that can be used to turn a column into the ground or, as a rod that can be driven through the interior of a column into the ground.

20 Claims, 1 Drawing Sheet

(56) References Cited

U.S. PATENT DOCUMENTS 5,139,235 A * 8/1992 Kilmer ..... E04H 17/22 52/157
5,163,321 A 11/1992 Perales
5,803,177 A 9/1998 Hriscu et al.
6,098,717 A 8/2000 Bailey et al.
6,321,861 B1 * 11/2001 Leichter ..... E04H 12/2223 175/323
6,367,845 B1 4/2002 Otten et al.
6,443,881 B1 9/2002 Finger et al.
6,581,682 B1 6/2003 Parent et al.
6,640,893 B1 11/2003 Rummel et al.
6,695,061 B2 2/2004 Fripp et al.
7,007,910 B1 * 3/2006 Krinner ..... E04H 12/2215 52/165
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 * 3/2017 Xu ..... C22C 32/00
9,624,752 B2 4/2017 Resink
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2003/0159829 A1 8/2003 Fripp et al.
2004/0118572 A1 6/2004 Whanger et al.
2004/0149418 A1 8/2004 Bosma et al.
2004/0244994 A1 12/2004 Jackson
2005/0039927 A1 2/2005 Wetzel et al.
2005/0092485 A1 5/2005 Brezinski et al.
2005/0171248 A1 8/2005 Li et al.
2005/0199401 A1 9/2005 Patel et al.
2005/0257961 A1 11/2005 Snell et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 6/2008 Marya et al.
2008/0185150 A1 8/2008 Brown
2008/0185158 A1 8/2008 Chalker et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0163252 A1 7/2010 Regnault De La Mothe et al.
2010/0212891 A1 8/2010 Stewart et al.
2010/0270031 A1 10/2010 Patel
2010/0307770 A1 12/2010 Sponchia et al.
2011/0073310 A1 3/2011 Clemens
2011/0098202 A1 4/2011 James et al.
2011/0174504 A1 7/2011 Wright et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Droger et al.
2015/0369027 A1 12/2015 Jones et al.
2016/0032696 A1 2/2016 Caccialupi et al.
2016/0137912 A1 * 5/2016 Sherman ..... C09K 8/706 166/243
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0319633 A1 11/2016 Cooper et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0234103 A1 8/2017 Frazier
2017/0335673 A1 11/2017 Burke et al.
2018/0078998 A1 3/2018 Sherman
2018/0085154 A1 3/2018 Kulper et al.
2018/0087346 A1 3/2018 Rochen
2018/0087350 A1 * 3/2018 Sherman ..... E21B 43/086
2018/0266215 A1 9/2018 Fagley, IV et al.
2018/0355691 A1 12/2018 Andersen
2018/0355693 A1 12/2018 Al-Abduljabbar et al.
2019/0017285 A1 * 1/2019 Kain ..... E04H 12/22

(56) References Cited

U.S. PATENT DOCUMENTS

| | | | | |
|---|---|---|---|---|
| 2019/0055808 | A1 | 2/2019 | Krueger | |
| 2019/0055839 | A1 | 2/2019 | Skillingstad et al. | |
| 2019/0128074 | A1 | 5/2019 | Stokes et al. | |
| 2019/0153852 | A1 | 5/2019 | Lallemand et al. | |
| 2019/0203101 | A1 | 7/2019 | Dusterhoft et al. | |
| 2019/0249509 | A1 | 8/2019 | Jakkula et al. | |
| 2019/0360297 | A1 | 11/2019 | Heiman et al. | |
| 2020/0240235 | A1 | 7/2020 | Fripp et al. | |
| 2020/0325749 | A1 | 10/2020 | Fripp et al. | |
| 2020/0370391 | A1 | 11/2020 | Fripp et al. | |
| 2021/0017441 | A1 | 1/2021 | Fripp et al. | |
| 2021/0079756 | A1 | 3/2021 | Ornelaz et al. | |
| 2021/0140255 | A1 | 5/2021 | Greci et al. | |
| 2021/0189817 | A1 | 6/2021 | Fripp et al. | |
| 2021/0332659 | A1 | 10/2021 | Fripp et al. | |
| 2021/0353037 | A1* | 11/2021 | Cote | E04H 12/2215 |
| 2022/0074221 | A1* | 3/2022 | Laimbeer | E04H 17/20 |

FOREIGN PATENT DOCUMENTS

| | | | | |
|---|---|---|---|---|
| CA | 3085547 | A1 | 8/2019 | |
| CN | 1708631 | A | 12/2005 | |
| CN | 102027189 | A | 4/2011 | |
| CN | 104583530 | A | 4/2015 | |
| CN | 105422146 | A | 3/2016 | |
| CN | 106522923 | A | 3/2017 | |
| CN | 107148444 | A | 9/2017 | |
| CN | 107250321 | A | 10/2017 | |
| CN | 107532466 | A | 1/2018 | |
| EP | 2399000 | A2 | 12/2011 | |
| EP | 2217790 | B1 | 10/2016 | |
| EP | 2753791 | B1 | 6/2017 | |
| FR | 3073549 | A1 | 5/2019 | |
| GB | 2381278 | A * | 4/2003 | E04H 12/2223 |
| GB | 2416796 | A | 2/2006 | |
| GB | 2469723 | A | 10/2010 | |
| GB | 2514195 | B | 6/2019 | |
| GB | 2583232 | A | 10/2020 | |
| GB | 2557397 | B | 8/2021 | |
| MX | 2011008597 | A | 9/2011 | |
| RU | 2424419 | C1 | 7/2011 | |
| RU | 2588501 | C2 | 6/2016 | |
| RU | 182236 | U1 | 8/2018 | |
| WO | 0026501 | A1 | 5/2000 | |
| WO | 2008079486 | A1 | 7/2008 | |
| WO | 2010096417 | A2 | 8/2010 | |
| WO | 2012090056 | A2 | 7/2012 | |
| WO | 2014098885 | A1 | 6/2014 | |
| WO | 2014110382 | A1 | 7/2014 | |
| WO | 2014210283 | A1 | 12/2014 | |
| WO | 2016171666 | A1 | 10/2016 | |
| WO | 2018005740 | A1 | 1/2018 | |
| WO | 2018057361 | A1 | 3/2018 | |
| WO | 2018085102 | A1 | 5/2018 | |
| WO | 2018147833 | A1 | 8/2018 | |
| WO | 2019094044 | A1 | 5/2019 | |
| WO | 2019147285 | A1 | 8/2019 | |
| WO | 2019164492 | A1 | 8/2019 | |
| WO | 2019164499 | A1 | 8/2019 | |
| WO | 2020005252 | A1 | 1/2020 | |
| WO | 2020018110 | A1 | 1/2020 | |
| WO | 2020068037 | A1 | 4/2020 | |
| WO | 2021021203 | A1 | 2/2021 | |
| WO | 2021076141 | A1 | 4/2021 | |

OTHER PUBLICATIONS

Search Report in FR Application No. 1859379, dated Oct. 15, 2019.
International Search Report and Written Opinion dated Nov. 19, 2018; International PCT Application No. PCT/US2018/019337.
Denmark Examination Report and Search Report dated Mar. 16, 2021, Denmark Application No. PA202070389.
International Search Report and Written Opinion dated Jul. 8, 2020, issued in related International Application No. PCT/US2019/056814.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
NEMISIS Annulus Swellable Packer, Weatherford, Swellable Products, 2009-2011.
International Search Report and Written Opinion date dated Nov. 22, 2019; International PCT Application No. PCT/US2019/019210.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-413, Petroleum Exploration and Development, vol. 42, Issue 3.
Dutch Search Report issued in NL 2026726, dated Aug. 13, 2021.
International Search Report and Written Opinion in PCT/US2020/066193, dated Sep. 8, 2021.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated Jan. 18, 2022.
International Search Report & Written Opinion in PCT/US2020/065539, dated Aug. 30, 2021.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.
Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.

(56) References Cited

OTHER PUBLICATIONS

DK Examination Report in Application No. PA 202070389, dated Oct. 20, 2021.
International Preliminary Report on Patentability in PCT/US2019/068493, dated Jun. 30, 2022.
International Preliminary Report on Patentability in PCT/US2019/068497, dated Jun. 30, 2022.

* cited by examiner

EXPANDABLE METAL FOR ANCHORING POSTS

The present disclosure relates generally to apparatus, compositions and methods for anchoring columns or posts in the ground, among other features.

BACKGROUND

Posts and columns when set into the ground frequently employ cement or a mortar to support the posts or columns. Over time, the cement or mortar may crack or degrade losing its supporting and anchoring capacity. If the posts or column comprise wood, the cracked cement or mortar accelerates the rotting of the wood. If the posts or column comprise a metal, the cracked cement or mortar accelerates the oxidation of the metal.

BRIEF DESCRIPTION OF THE DRAWINGS

The accompanying drawings, which are included to provide a further understanding of the disclosure, are incorporated in and constitute a part of this specification, illustrate embodiments of the disclosure and, together with the detailed description, serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 3:
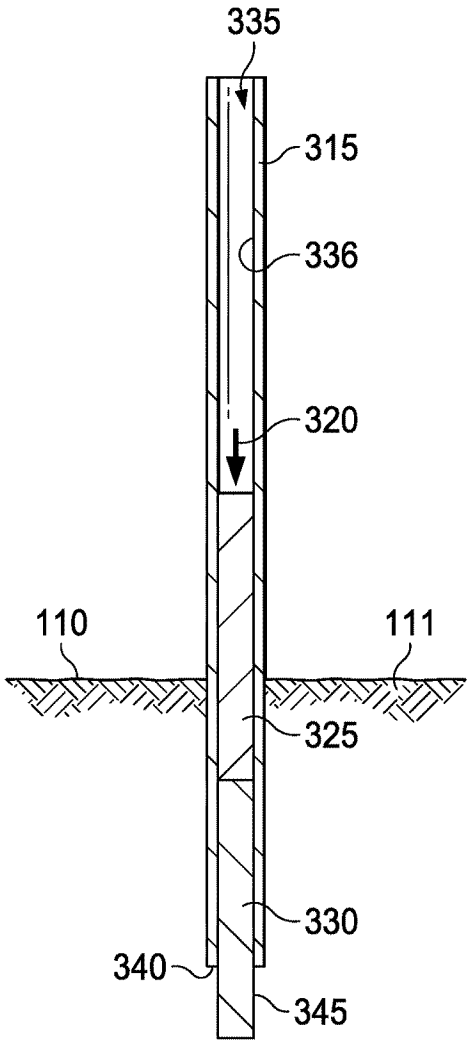
FIG. 3 is a cross-sectional view of a hollow column being anchored by driving a column into the ground and then installing one or more expanding metal rods through the core of the hollow column, configured according to principles of the disclosure.

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

The terms including, comprising and variations thereof, as used in this disclosure, mean including, but not limited to, unless expressly specified otherwise.

The terms "a", "an", and "the", as used in this disclosure, means "one or more", unless expressly specified otherwise. The terms column and post are synonymous herein. The term "about" refers to +/−10% of a dimension specified, unless context specifies otherwise.

OVERVIEW

In embodiments, preformed devices comprising expandable metals are described herein for setting columns into the ground. In an embodiment, a granular expandable composition is described. Expandable metals comprise one or more metals that expand in response to hydrolysis. The resulting hydrolyzed expanded metal is strong and tends to fill in spaces and cavities, even over time, which is a useful feature when setting columns into the ground. The hydrolysis can be accomplished by water ordinarily found in the ground in most locations for setting a column. Alternatively, a hydrolyzing fluid can be supplied, as necessary, to cause the hydrolysis of the expanding metal. Upon hydrolysis, the expanding metal expands around the column to adhere and grip the column securely, while the expandable metal may also expand outwardly in the ground to increase cross-sectional bulk lending to a more overall stabilization of a set column. If subject to stress that may create a fault, such as a crack, the hydrolyzed expanding metal tends to heal itself, if necessary, over time. The columns herein may be installed vertically or at an angle to the surface of the ground including horizontal installation such as, e.g., setting a column in a vertical orientated earthen wall or cliff.

Figure 1:
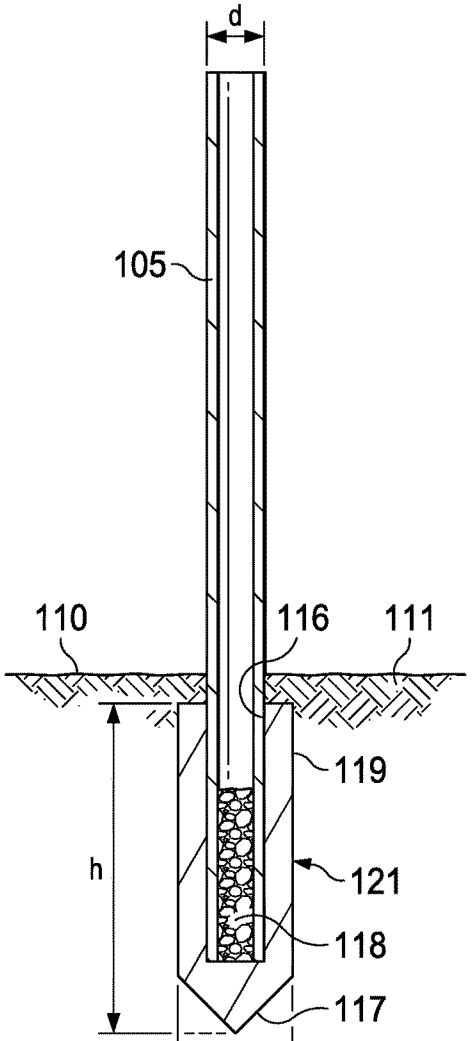
FIG. 1 is a cross-sectional view of a column anchored in the ground using an expandable metal sleeve for setting the column, configured according to principles of the disclosure.

FIG. 1 is a diagram of a column 105 anchored in the ground 111 using an expandable metal sleeve 121 for setting the column 105. The column 105 may comprise a rod, post, pillar or the like. The column 105 be solid or may be hollow and may comprise metal, wood, stone, composites, plastic or similar materials. The column 105 may have any outer shape and circumference, such as round, circular oval, square or the like. The column 105 may be hollow and have an inner circumference about an interior surface.

The expandable metal sleeve 121 may be preformed, and may be sized and shaped according to intended applications. That is, the bigger the column 105 to be supported, the expandable metal sleeve 121 may be sized accordingly. The expandable metal sleeve 121 may be preformed by casting, milling or other construction processes. The expandable metal sleeve 121 may have an internal cavity 116 formed by an inner surface of a wall 119 and the expandable metal sleeve 121 configured to accept a column 105 of a particular width or diameter d. The shape of the internal cavity 116 would match the shape of the outer perimeter or outer surface of the column. The expandable metal sleeve 121 may be preformed to have an overall height h. The overall height h may be selected in accordance with the anticipated overall height of the column, or other application requirement, to provide a sufficient stabilization capability. Therefore, different sized expandable metal sleeves 121 may have different sized diameters or width of internal cavities 116 for accepting a particular sized column with a similar diameter or width. Moreover, different sized expandable metal sleeves 121 may have different sized overall height h. The expandable metal sleeve 121 may be formed with a point 117 at the lower end for penetrating the ground 111.

In use, the preformed expandable metal sleeve 121 may be set into the ground 111 at the surface 110 and partially driven into the ground 111. The column 105 may be inserted into, or coupled with, the expandable metal sleeve 121 and both column 105 and expandable metal sleeve 121 may be driven into the ground 111 to a desired depth. Alternatively, the column 105 may be inserted into the expandable metal sleeve 121 at the surface 110 and both the column 105 and the expandable metal sleeve 121 may be driven together into the ground to a desired depth. A hydrolyzing fluid, such as water, may be applied from the surface to the expandable metal sleeve 121 in the ground 111 to initiate hydrolysis, or water from the ground itself may cause the hydrolysis. Once the expanding metal has expanded due to hydrolysis, the column is firmly set into the ground with the expandable metal sleeve 121 solidly binding to the column 105. The column 105 may be a solid column, or may be a hollow column, and also may have any shape such as round, circular, oval, square, or the like.

In an embodiment, granular expandable metal 118 may be used and poured down the column 105 for added strength at the base of the column 105, but is not required. Granular expandable metal may hydrolyze and bond with the preformed expanding metal 121 at the base of the column 105. In embodiments, the granular expandable metal 118 may be used alone in lieu of the preformed expanding metal 121 to set the column 105 into the ground 111, but would require a hole to be dug beforehand, as is analogously done when using cement. Granular expanding metal may be hydrolyzed by ground water or as otherwise supplied from the surface.

Figure 2:
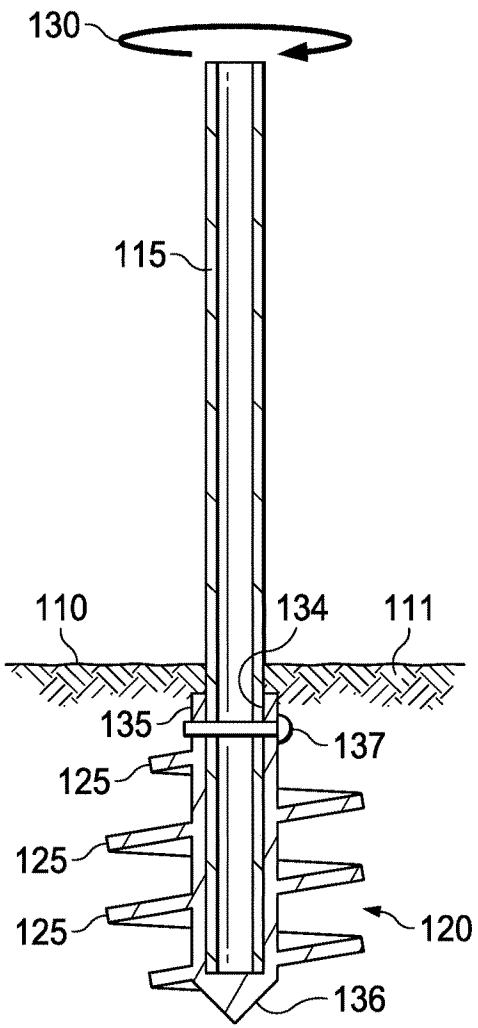
FIG. 2 is a cross-sectional view of a column being anchored with an auger made from an expandable metal, configured according to principles of the disclosure.

FIG. 2 is a diagram of a column 115 being anchored with an auger 120 made from an expandable metal. The column 115 be solid or may be hollow and may comprise metal, wood, stone, composites, plastic or similar materials. The column 115 may have an outer circumference about an outer surface and may have any outer shape, such as round, circular, oval, square or the like. The column 115 may be have an inner circumference about an interior surface, and also may have any shape such as round, oval, square, or the like.

The auger 120 may be preformed and may comprise a blade 125 that may be a continuous spiral about, connected with, and extending laterally from a wall 135, and may have an end tip 136. The wall 135 of auger 120 forms a hollow compartment 134 for receiving a column 115 therewithin. The compartment 134 has an inner circumference and is shaped to accept a column 115 having a particular outer circumference and shape. Therefore, there may be different sized augers 120 having different sized or shaped compartments 134, and/or different sized overall blade 125 in a circumferential dimension, and different sized height of the auger 120. A more common shape of the compartment 134 may be a circular compartment for accepting circular columns 115. But, other shapes may be employed, such as a square, oval, rectangle, or the like to match expected shapes of columns for an application. The column 115 may be a solid or hollow column and may be inserted into, or coupled with, the auger 120, such as by sliding the column 115 into the auger 120. The outer circumference of the column 115 slideably couples with the inner circumference of the wall 135. A retaining mechanism 137, such as, e.g., a bolt, may be used to hold the column within the auger 120 so that a rotation force 130 can be imparted to the column 115 and the auger 120 for driving or turning the column 115 and auger 120 into the ground 111 from the surface 110.

The blade 125 of the auger 120 may be a continuous blade or may be a discontinuous blade. That is, the blade does not have to be continuously spiraled about the wall 135, but may have breaks or interruptions. The blade 125 may also have serrations on its edge to help bite into the ground 111. The blade 125 and wall 135 may comprise an expandable metal. Once set into the ground 111, the combination of column 115 and auger 120 become bonded together once the expandable metal of the wall 135 hydrolyzes. Moreover, the expandable metal of the auger 120 also expands outwardly into the ground 111 increasing support strength even more. The expandable metal of the auger 120 also tends to heal itself over time if any damage or stress fractures develop. Hydrolyzing fluid may be supplied from the surface 110 or, water in the ground 111 may provide the hydrolyzing fluid as water, which can come from rain.

In an embodiment, the column 115 may be pre-bonded to the auger 120 before installation by inserting the column 115 into the auger 120 and hydrolyzing the expandable metal so that the column 115 and auger 120 are bonded together. This embodiment may not require a securing mechanism 137 to hold the column 115 and auger 120 together for rotation 130.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al-Aluminum, Zn-Zinc, Mn-Manganese, Zr-Zirconium, Y-Yttrium, Nd-Neodymium, Gd-Gadolinium, Ag-Silver, Ca-Calcium, Sn-Tin, and Re-Rhenium, Cu-Copper. In some embodiments, the alloy can be alloyed with a dopant that promotes corrosion, such as Ni-Nickel, Fe-Iron, Cu-Copper, Co-Cobalt, Ir-Iridium, Au-Gold, C-Carbon, gallium, indium, mercury, bismuth, tin, and Pd-Palladium. The metal alloy can be constructed in a solid solution process where the elements are combined with molten metal or metal alloy. Alternatively, the metal alloy could be constructed with a powder metallurgy process. The expandable metal sleeve 121 can be cast, forged, extruded, or a combination thereof.

The expanding metal rods 325, 330 may be pre-sized to approximate the inner diameter and shape of the core 335, but with sufficient tolerance to still slide through the core 335. Therefore, there may be different sized expanding metal rods 325, 330 of different diameters for insertion into a column 315 of a particular sized core 325.

One or more of expanding metal rods 325, 330 may be driven past the bottom end 340 of the column 315 so that the expanding metal rods hydrolyze and expand to provide a strong base, as well as reinforce the inner diameter of the column 315 near the bottom end 340. This will also keep the column 315 dry to prevent rust or rot. Moisture present typically will be absorbed by the expanding metal rods 325, 330. Moreover, the base formed by the expanding metal rods 325, 330 is less likely to crack, and if it does crack will tend to heal itself. The column 315 may be hollow and have an inner circumference about an interior surface, and also may have any shape such as round, oval, square, or the like.

The expandable metal described in relation to FIGS. 1-3 may be granulated, or the expandable metal may be machined as a preformed device to any specific size/shape, extruded, formed, cast or other conventional ways to produce the desired shape of an expandable metal sleeve 121, auger 120, or expanding metal rods 325, 330. The expandable metal may have a thickness that supplies a desired strength before and after hydrolysis. For example, the overall width D of expandable metal sleeve 121 may be selected from a range of about 2" to about 16", but can be more or less, and may depend on the column 105 size to be used. The thickness of expandable metal of the blades 125 may be selected from a range of about 0.25" to about 1.0", but can be more or less. The diameter of the expanding metal rods

325, 330 may be selected from a range of about 1.0" to about 8.0", but can be more or less, and may depend on column size to be used.

In general, and in relation to the previously described uses of the expandable metal of FIGS. 1-3, the hydrolysis of any metal can create a metal hydroxide. The formative properties of alkaline earth metals (Mg-Magnesium, Ca-Calcium, etc.) and transition metals (Zn-Zinc, Al-Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

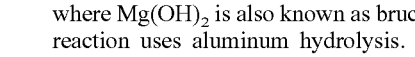

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

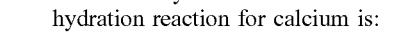

$$Al+3H_2O \rightarrow Al(OH)_3+3/2H_2.$$

Another hydration reactions uses calcium hydrolysis. The hydration reaction for calcium is:

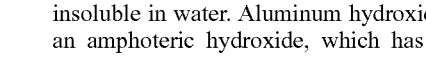

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al-Aluminum, Zn-Zinc, Mn-Manganese, Zr-Zirconium, Y-Yttrium, Nd-Neodymium, Gd-Gadolinium, Ag-Silver, Ca-Calcium, Sn-Tin, and Re-Rhenium, Cu-Copper. In some embodiments, the alloy can be alloyed with a dopant that promotes corrosion, such as Ni-Nickel, Fe-Iron, Cu-Copper, Co-Cobalt, Ir-Iridium, Au-Gold, C-Carbon, gallium, indium, mercury, bismuth, tin, and Pd-Palladium. The metal alloy can be constructed in a solid solution process where the elements are combined with molten metal or metal alloy. Alternatively, the metal alloy could be constructed with a powder metallurgy process. The expandable metal sleeves 160*a*, 160*b* can be cast, forged, extruded, or a combination thereof.

Optionally, non-expanding components may be added to the starting expanding metal materials. For example, ceramic, elastomer, glass, or non-reacting metal components can be embedded in the expanding metal or coated on the surface of the expanding metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, and phosphate. The metal can be alloyed to increase the reactivity or to control the formation of oxides.

The expandable metal can be configured as a preformed device in many different fashions, as long as an adequate volume of material is available for fully expanding to provide column support. Additionally, a coating may be applied to one or more portions of the expandable metal to delay the expanding reactions.

The use of the expandable metals as described herein does not require any use of cement or mortar to set columns, pilings, posts, vertical structures or the like. The use of the expandable metals as described herein provides a long term solution for self-healing cracks or defects that might arise from use, and may be left in the ground permanently.

The following paragraphs include an alternate description of certain aspects of the disclosure.

Clause 1: An apparatus for setting a column into the ground, comprising a preformed device comprising an expandable metal that expands in response to hydrolysis, the preformed device having at least one circumference, wherein the at least one circumference of the preformed device is sized to couple with a surface of a column having a circumference of about the same dimension as the at least one circumference of the preformed device for setting the column into the ground.

Clause 2: The apparatus of clause 1, wherein the at least one circumference is formed by a surface of an inner wall of the preformed device, and the surface of the column comprises an outer surface of the column.

Clause 3: The apparatus of clauses 1 or 2, wherein the preformed device comprises a sleeve with a cavity formed therewithin, the cavity having an inner surface, the circumference of the inner surface being the at least one circumference.

Clause 4: The apparatus of clauses 1 or 2, wherein the preformed device comprises an auger.

Clause 5: The apparatus of clause 4, wherein the auger comprises a spiral blade configured about a wall, the wall also forming a hollow compartment for receiving the column therewithin, an inner circumference of the wall being the at least one circumference, wherein the spiral blade and the wall comprises expandable metal.

Clause 6: The apparatus of clauses 4 or 5, further comprising a retaining mechanism configured to secure the auger to the column during rotation of the auger.

Clause 7: The apparatus of clause 1, wherein the at least one circumference is formed by an outer surface of the preformed device and the surface of the column comprises and inner surface of the column.

Clause 8: The apparatus of clause 7, wherein the preformed device is insertable into a core of the column formed by the inner surface.

Clause 9: The apparatus of clause 8, wherein the preformed device comprises an expanding metal rod that expands in response to hydrolysis and is drivable through the column for setting the column into the ground.

Clause 10: The apparatus of any one of clauses 1-9, wherein the at least one circumference of the preformed device is circular.

Clause 11: An apparatus for setting a column into the ground, comprising: a preformed device comprising an expandable metal that expands in response to hydrolysis, the preformed device having a circumference sized and shaped to match a circumference of a column for setting the column into the ground.

Clause 12: The apparatus of clause 11, wherein the preformed device comprises a sleeve having a wall with an internal circumference for receiving the column therewithin.

Clause 13: The apparatus of clause 12, wherein the sleeve is configured to be driven into the ground by the column, and the sleeve is configured to be hydrolyzed while in the ground.

Clause 14: The apparatus of clause 11, wherein the preformed device comprises an auger with blades, the auger configured to receive the column therewithin for setting the column in the ground, the auger and blades hydrolysable in the ground.

Clause 15: The apparatus of clause 11, wherein the preformed device comprises an expanding metal rod that is drivable through the column for setting the column into the ground, and expanding metal rod is hydrolyzable in the ground.

Clause 16: A method comprising: providing at least one preformed device comprising an expandable metal that expands in response to hydrolysis, the at least one preformed device having at least one circumference, wherein the at least one circumference of the at least one preformed device is sized to couple with a surface of a column having a circumference of about the same dimension as the at least one circumference of the preformed device; and setting the column into the ground using the preformed device.

Clause 17: The method of clause 16, wherein in the providing step, the preformed device comprises a sleeve having a wall with an internal circumference for receiving the column therewithin, and the sleeve is configured to be driven into the ground by the column, and the sleeve is configured to be hydrolyzed while in the ground.

Clause 18: The method of clause 16, wherein in the providing step, the preformed device comprises an auger with blades, the auger configured to receive the column therewithin for setting the column in the ground, the auger and blades hydrolyzable in the ground.

Clause 19: The apparatus of clause 16 wherein in the providing step, the preformed device comprises an expanding metal rod that is drivable through the column for setting the column into the ground, and hydrolyzes in the ground.

Clause 20: The apparatus of clause 16, wherein in the providing step, the at least one circumference of the at least one preformed device is circular.

While the disclosure has been described in terms of exemplary embodiments, those skilled in the art will recognize that the disclosure can be practiced with modifications in the spirit and scope of the appended claim, drawings and attachment. The examples provided herein are merely illustrative and are not meant to be an exhaustive list of all possible designs, embodiments, applications or modifications of the disclosure.

What is claimed is:

1. An apparatus for setting a column into the ground, comprising:

a column;

a preformed device comprising an expandable metal that expands in response to hydrolysis, the preformed device having at least one circumference, wherein the at least one circumference of the preformed device is sized to couple with a surface of the column having a circumference of about the same dimension as the at least one circumference of the preformed device for setting the column into the ground; and granular expandable metal configured to be placed within an interior of the column.

2. The apparatus of claim 1, wherein the at least one circumference is formed by a surface of an inner wall of the preformed device, and the surface of the column comprises an outer surface of the column.

3. The apparatus of claim 1, wherein the preformed device comprises a sleeve with a cavity formed therewithin, the cavity having an inner surface, the circumference of the inner surface being the at least one circumference.

4. The apparatus of claim 1, wherein the preformed device comprises a auger.

5. The apparatus of claim 4, wherein the auger comprises a spiral blade configured about a wall, the wall also forming a hollow compartment for receiving the column therewithin, an inner circumference of the wall being the at least one circumference, wherein the spiral blade and the wall comprises expandable metal.

6. The apparatus of claim 4, further comprising a retaining mechanism configured to secure the auger to the column during rotation of the auger.

7. The apparatus of claim 1, wherein the at least one circumference is formed by an outer surface of the preformed device and the surface of the column comprises an inner surface of the column.

8. The apparatus of claim 7, wherein the preformed device is insertable into a core of the column formed by the inner surface.

9. The apparatus of claim 8, wherein the preformed device comprises an expanding metal rod that expands in response to hydrolysis and is drivable through the column for setting the column into the ground.

10. The apparatus of claim 1, wherein the at least one circumference of the preformed device is circular.

11. An apparatus for setting a column into the ground, comprising:

a preformed device comprising an expandable metal that expands in response to hydrolysis, the preformed device having a circumference sized and shaped to match a circumference of a column for setting the column into the ground; and granular expandable metal configured to be placed within an interior of the column.

12. The apparatus of claim 11, wherein the preformed device comprises a sleeve having a wall with an internal circumference for receiving the column therewithin.

13. The apparatus of claim 12, wherein the sleeve is configured to be driven into the ground by the column, and the sleeve is configured to be hydrolyzed while in the ground.

14. The apparatus of claim 11, wherein the preformed device comprises an auger with blades, the auger configured to receive the column therewithin for setting the column in the ground, the auger and blades hydrolysable in the ground.

15. The apparatus of claim 11, wherein the preformed device comprises an expanding metal rod that is drivable through the column for setting the column into the ground, and expanding metal rod is hydrolyzable in the ground.

16. A method comprising:

providing at least one preformed device comprising an expandable metal that expands in response to hydrolysis, the at least one preformed device having at least one circumference, wherein the at least one circumference of the at least one preformed device is sized to couple with a surface of a column having a circumference of about the same dimension as the at least one circumference of the preformed device;

setting the column into the ground using the preformed device; and pouring granular expandable metal within an interior of the column.

17. The method of claim 16, wherein in the providing step, the preformed device comprises a sleeve having a wall with an internal circumference for receiving the column therewithin, and the sleeve is configured to be driven into the ground by the column, and the sleeve is configured to be hydrolyzed while in the ground.

18. The method of claim 16, wherein in the providing step, the preformed device comprises an auger with blades, the auger configured to receive the column therewithin for setting the column in the ground, the auger and blades hydrolyzable in the ground.

19. The method of claim 16 wherein in the providing step, the preformed device comprises an expanding metal rod that is drivable through the column for setting the column into the ground, and hydrolyzes in the ground.

20. The method of claim 16, wherein in the providing step, the at least one circumference of the at least one preformed device is circular.

* * * * *